US005531868A

United States Patent [19]

Miller et al.

[11] Patent Number: 5,531,868

[45] Date of Patent: Jul. 2, 1996

[54] ADVANCED ELECTROREFINER DESIGN

[75] Inventors: William E. Miller, Naperville; Eddie C. Gay, Park Forest; Zygmunt Tomczuk, Lockport, all of Ill.

[73] Assignee: The United States of America as represented by the United States Department of Energy, Washington, D.C.

[21] Appl. No.: 267,949

[22] Filed: Jul. 6, 1994

[51] Int. Cl.[6] ..... C25C 3/34

[52] U.S. Cl. ..... 205/44; 204/243 R; 204/250; 204/272; 204/273; 976/DIG. 280; 205/47

[58] Field of Search ..... 204/1.5, 64 R, 204/272, 273, 243 R, 250; 976/280

[56] References Cited

U.S. PATENT DOCUMENTS

| | | | |
|---|---|---|---|
| 2,951,793 | 9/1960 | Hansen | 204/1.5 |
| 4,242,192 | 12/1980 | Dunning | 204/213 |
| 4,596,647 | 6/1986 | Miller | 204/212 |
| 4,855,030 | 8/1989 | Miller | 204/212 |
| 4,880,506 | 11/1989 | Ackerman | 204/1.5 |
| 4,995,948 | 2/1991 | Poa | 204/1.5 |
| 5,009,752 | 4/1991 | Tomczuk | 204/64 |
| 5,348,626 | 9/1994 | Miller | 204/1.5 |
| 5,356,605 | 10/1994 | Tomczuk | 423/251 |
| 5,370,781 | 12/1994 | Van de Wynckel | 204/280 |

*Primary Examiner*—John Niebling
*Assistant Examiner*—Brendan Mee
*Attorney, Agent, or Firm*—Tim Harney; Hugh Glenn; William R. Moser

[57] ABSTRACT

A combination anode and cathode for an electrorefiner which includes a hollow cathode and an anode positioned inside the hollow cathode such that a portion of the anode is near the cathode. A retaining member is positioned at the bottom of the cathode. Mechanism is included for providing relative movement between the anode and the cathode during deposition of metal on the inside surface of the cathode during operation of the electrorefiner to refine spent nuclear fuel. A method is also disclosed which includes electrical power means selectively connectable to the anode and the hollow cathode for providing electrical power to the cell components, electrically transferring uranium values and plutonium values from the anode to the electrolyte, and electrolytically depositing substantially pure uranium on the hollow cathode. Uranium and plutonium are deposited at a liquid cathode together after the $PuCl_3$ to $UCl_3$ ratio is greater than 2:1. Slots in the hollow cathode provides close anode access for the liquid pool in the liquid cathode.

19 Claims, 2 Drawing Sheets

Fig. 3
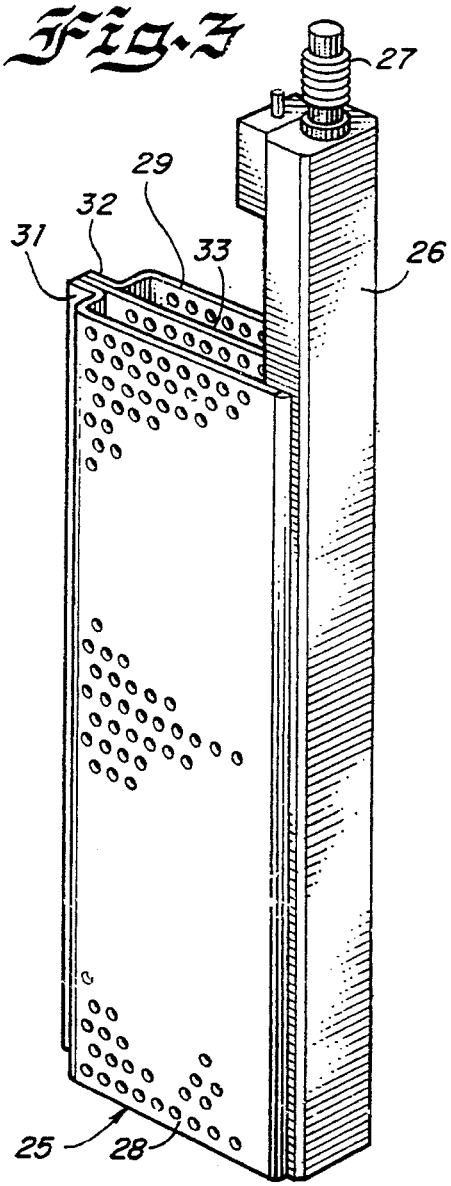
Fig. 4
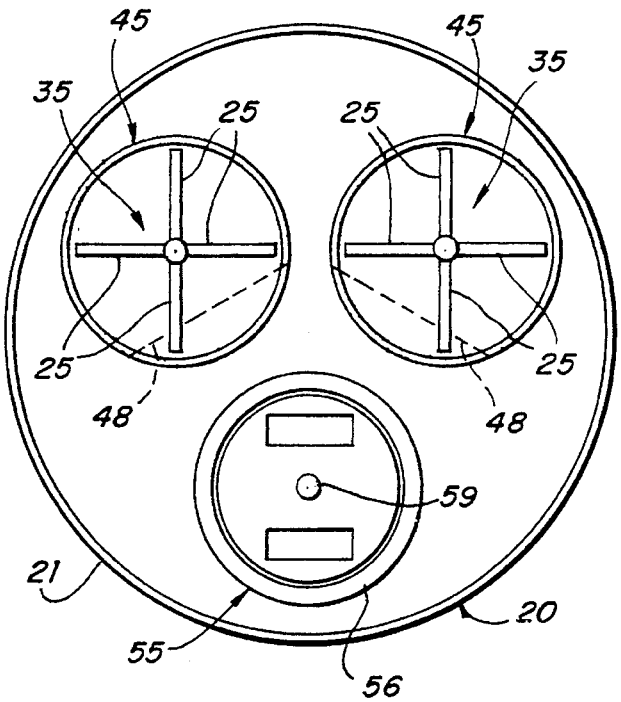
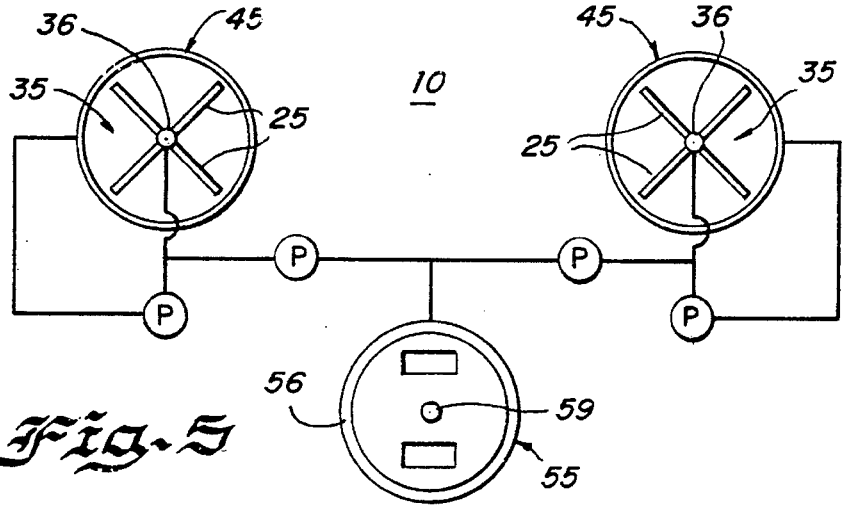
Fig. 5

ADVANCED ELECTROREFINER DESIGN

CONTRACTUAL ORIGIN OF THE INVENTION

The United States Government has rights in this invention pursuant to Contract No. W-31-109-ENG-38 between the U.S. Department of Energy and The University of Chicago representing Argonne National Laboratory.

BACKGROUND OF THE INVENTION

This invention relates to a process and apparatus for electrochemically refining spent nuclear fuel from a nuclear reactor and recovering purified uranium and a mixture of uranium and plutonium for use as fresh blanket and core fuel in a nuclear reactor. The invention relates to a electrorefiner of the type wherein spent blanket and core fuel is refined in a single electrorefining cell by transferring uranium and plutonium from the spent fuel optionally to a molten cadmium pool or directly to an electrolyte and thereafter electrolytically depositing purified uranium on a solid cathode and subsequentially electrolytically depositing a mixture of uranium and plutonium on a second liquid metal cathode, preferred cadmium.

Electrorefining processes have been generally used to recover high purity metal or metals from impure feed materials and more particularly to recover materials such as uranium and plutonium from spent nuclear fuel. Electrorefining of spent nuclear fuel is carried out in a electrolysis cell of the kind disclosed in U.S. Pat. Nos. 2,951,793, 4,596,647, 4,880,506, 4,855,030 and 5,009,752, the disclosures of each of these patents being incorporated herein by reference and are generally indicative of the prior art in this field.

In such cells as disclosed in the above-mentioned patents, the spent nuclear fuel forms the anode or is dissolved in an anode pool. An electrolytic fuel cell is used, and the purified metal is transferred electrolytically and collected on the cathode. In other designs, an anode pool is located at the bottom of the cell, and the cathode may be located above the anode in the electrolyte pool. It has been found in the prior art that relatively pure uranium can be electrolytically deposited on a solid cathode and thereafter mixtures of uranium and plutonium can be deposited on a molten metal cathode such as cadmium, see the above-identified U.S. Pat. No. 4,880,506. In all of the art cited above, and in the electrorefining process as it now exists, the anode is located no closer than about 9 inches to the cathode. This is the state of the art as it existed before the subject invention. It is understood that the electrical resistance of the cell is greatly influenced by the space between the anode and the cathode and the cell resistance is such that the limiting average electrical current is about 200 amperes in the current test cell at Argonne National Laboratory, for transport from the anode to the solid cathode for uranium collection and about 80 amperes for transfer to the liquid cathode such as cadmium for the collection of a combination of plutonium and uranium. Since the transport rate is directly proportional to cell current, decreasing the cell resistance increases the transport rate; otherwise, the preset voltage limit is reached earlier due to the higher resistance.

SUMMARY OF THE INVENTION

Accordingly, it is an object of the present invention to improve the collection efficiency of relatively pure uranium metal from spent nuclear fuel in an electrorefiner.

It is another object of the invention to increase the transport rate of the uranium and/or plutonium by physically locating the anode near the solid cathode.

Another object of the invention is to increase the current for the anode/solid cathode pair electrodes and to reduce the inefficiency of the cell design.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

FIG. 3 is a schematic representation of a portion of an anode mounted within a solid cathode;

FIG. 4 is a schematic representation of the physical location of a pair of solid cathodes in combination with the liquid cathode; and FIG. 5 is a schematic representation of a power supply arrangement for an electrolytic cell of the type herein disclosed.

DESCRIPTION OF THE PREFERRED EMBODIMENTS

Figure 1:
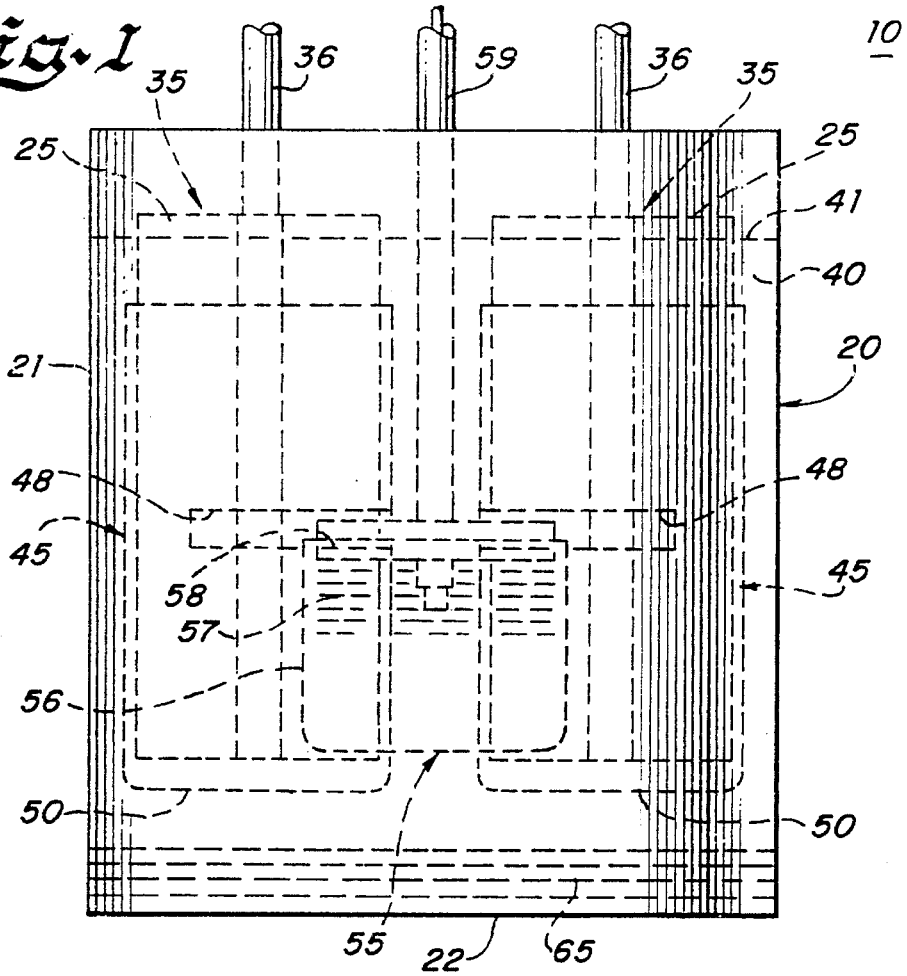
FIG. 1 is a schematic drawing of a portion of a electrolytic cell of the type disclosed showing the location of the solid and liquid cathodes in conjunction with the anodes.

Referring now to FIG. 1, there is schematically shown an electrolytic refiner 10 of the type previously disclosed in the Tomczuk et al. U.S. Pat. No. 5,009,752 and the Miller et al. U.S. Pat. No. 4,596,647, the disclosures of which have previously been incorporated herein by reference.

The Ackerman et al. U.S. Pat. No. 4,880,506, also previously incorporated herein by reference, shows the use of a molten metal cathode as will hereinafter be described and its disclosure is important for that aspect. In any event, the electrolytic refiner 10 includes a housing 20 comprised of side wall 21 and bottom 22 which encloses the various anodes, cathodes and electrolytes as hereinafter explained. Means for maintaining an elevated temperature in the apparatus are not shown, but are understood to be present.

Figure 2A:
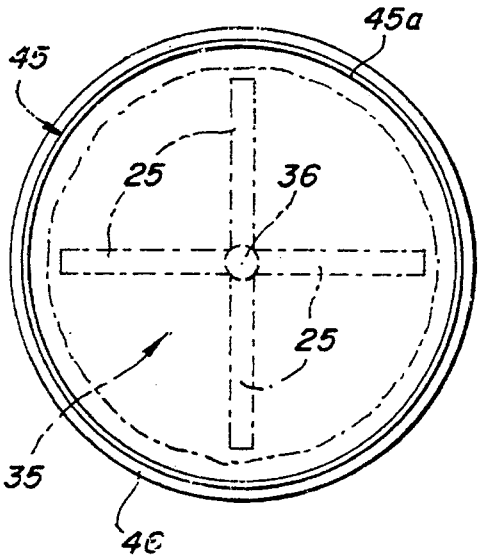
FIG. 2A and 2B are a schematic representation of a solid cathode having a rotatable anode positioned therewithin.
Figure 2B:
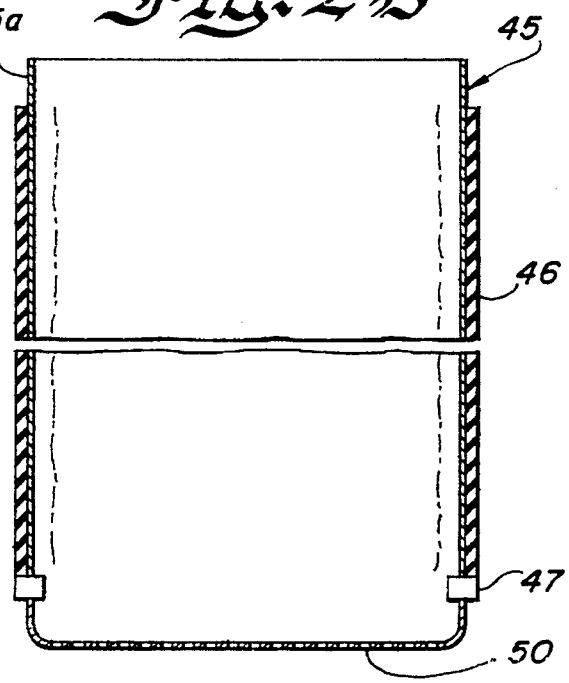

An anode container 25 as best illustrated in FIGS. 1–3 includes a central bus bar 26 and a mounting stud 27 which may be externally threaded, as shown. The anode container 25 includes a pair of apertured outer plates 28 and 29 each provided with a flange 31 and 32, respectively. An optional perforated or apertured divider plate 33 may be located between the outer plates 28 and 29 and trapped between the flanges 31 and 32 thereby to establish one or two compartments, depending on whether the inner plate 33 is present, for chopped spent nuclear fuel which is the anode material and which resides in the compartments between apertured plates 28 and 29. As shown in FIGS. 3 and 4, an anode assembly 35 may include four such anode containers 25 arranged in cruciform configuration in transverse cross section, a more detailed illustration of such appears in FIG. 2 of the '752 patent previously mentioned. The anode assembly 35 is connected to an anode drive mechanism 36 for rotational movement of the anode containers 25 about its axially extending axis.

An electrolyte 40 positioned in the housing 20 has the surface 41 thereof at a predetermined level comprised of halide salts, most preferably of chloride salts and may include various of the alkali and alkaline earth metals. More preferably, it is the eutectic of lithium and potassium chloride which may also contain the chlorides of uranium and plutonium during operation of the cell or refiner 10. The exact chemical make-up of the electrolyte 40 is well known and is to some extent dependent upon the cycle at which the cell is operating. For instance, during some portion of the cell cycle there will be cadmium chloride present and at other times it may not be present. In addition, as is understood, the plutonium to uranium ratio in the cell varies depending on what part of the cycle measurements are taken. The anode design is specifically adapted to enhance the flow of electrolyte through and around the anode container 25 so as to provide intimate contact between the electrolyte 40 and the nuclear fuel, all as well understood.

A plurality of cathodes 45 are provided in the electrorefiner 10 with two solid cathodes 45 being shown for purposes of illustration, it being understood that a greater number or a smaller number may be used or a plurality of individual cells of the type disclosed herein may be used. Each of the solid cathodes 45 is an elongated hollow member 45*a*, preferably tubular in shape and may be provided with electrical insulation 46 on the outer wall thereof. The cathode 45 is comprised principally of any suitable metal which may be ferrous or may be a molybdenum alloy, all as well known in the art. At the bottom of the metal tube 45*a* is an electrical insulator in the form of a ceramic spacer 47 and a retainer member 50 in the form of a metal or metallic screen, preferably zirconium. The retainer 50 may be any configuration which permits electrolyte 40 to flow freely therethrough, but if metal an electrical insulator such as a ceramic ring or spacer 47 is required. Zirconium is a preferred metal for retainer 50 since zirconium is present in the cell or refiner 10 because it is used as an alloying agent for the nuclear fuel, and therefore, the use of a zirconium screen 50 does not add a material which is foreign to the mix.

A horizontal slot 48 is provided in the cathode tubes 45*a* at a predetermined vertical distance above the bottom 22 of the container 20, for a purpose hereinafter set forth. Each of the anode assemblies 35 is positioned within one of the hollow tubular cathodes 45 with relative movement between the anode and cathode being provided by rotation of the anode assembly 35 within the cathode 45, the rotation being provided by the anode drive mechanism 36 connected as illustrated in FIG. 1. Of significance is the physical location of the anode 25 inside the cathode 45 such that the distal end of the anode assembly 35 is near the cathode wall 45*a*. By near, it is meant within a few inches and more preferably, less than one inch and most preferably between one-half and one-quarter inch from the cathode wall 45*a*. More particularly, as hereinafter will be set forth, as uranium is deposited on the inside of the cathode wall 45*a* during operation of the refiner 10, the distal ends of the anode assembly 35 scrape the deposited uranium material from the cathode wall 45*a* and the scraped material is collected by the retainer 50 in order to ensure complete recovery of the material.

A liquid metal cathode 55 is provided in the refiner 10 and is schematically shown in FIGS. 1 and 4, the liquid metal cathode 55 including a ceramic container 56 for housing a liquid metal 57 having the surface thereof at a predetermined level 58. A liquid metal agitator drive and lead assembly 59 is provided as is well known in the art. The slots 48 in the cathodes 45 should be positioned just above the level or surface of the liquid metal 57 in the metal cathode 55, as will be explained. Optionally, there may be provided a pool of molten metal 65 at the bottom of the electric electrorefiner 10, most preferably cadmium.

In the electrorefiner presently used, uranium is deposited on the solid cathode in a uniform cylindrical shape as the uranium achieved by abrading the deposit with scrapers located along the vessel wall and above and parallel with the cadmium pool surface for control of downward growth of the deposit. The scrapers are permanently located in place and as the cathode grows from an initial inch and three-quarter diameter mandrel to the finished eight inch cylinder, material which is abraded falls into the cadmium pool which is located at the bottom of the refiner. This results in a collection inefficiency since both energy and time are consumed to form the abraded material. In the present Argonne design of liquid cathode, essentially the same thing occurs since an impeller is used to remove any heavy metal which grows above the surface of the liquid cadmium pool contained in the cathode crucible. Presently, and before the subject invention, the collection efficiencies were about 50% for the solid cathode and 40% for the liquid cadmium cathode. Using the configuration and method of the present invention with the cell anode assembly 35 located inside the solid cathode 45 positioned such that during cell operation the anode assembly 35 rotates with respect to the cathode 45 to provide relative movement between the anode and cathode which improves the collection efficiency to nearly 100%.

In operation of the present invention, the electrode assembly containing both the anode 25 and cathode 45, both anodes and cathodes are located in the molten salt electrolyte 40. As the cathode deposit grows on the inside of the metal tube surface 45*a*, the gap between the outer tip of the anode assembly 35 and the cathode deposit closes. Each rotating anode assembly 35 acts as a scraper which abrades the associated deposit of uranium as it grows. The collector 50 which may be a zirconium screen as previously discussed, collects the abraded material so it may be withdrawn from the electrorefiner 10 with the electrode assembly after transport is completed. Because the uranium material on the screen 50 is retrieved with the electrode assembly, the collection efficiency is nearly 100%. Because plutonium will not deposit on a solid metal cathode 45, the liquid metal cathode 55 is required and it is positioned as previously described within the electrorefiner 10. Salt or electrolyte 40 must be free to flow from the anodes 35 to the liquid metal cathode 55, it being preferred that the liquid metal being cadmium. Mechanism by which this is accomplished include the slots 48 in the cathode tubes 45 located directly above the cadmium surface 58 in the liquid cadmium cathode 55. This configuration permits electrolyte 40 having a high concentration of uranium and plutonium ions to contact the liquid cadmium cathode 55 so as to facilitate transport of the uranium and plutonium values which deposit at the liquid cathode. The problem of dendrite removal and/or control previously addressed in the Miller U.S. Pat. No. 4,855,030, the disclosure of which has previously been incorporated herein by reference, is controlled by maintaining the weight ratio of plutonium chloride to uranium chloride to be in excess of 2:1. By maintaining the weight ratio of the plutonium and uranium chlorides as specified, dendrite formation is reduced. Accordingly, it is a significant advantage to begin the deposition of the mixed uranium plutonium deposits at the liquid cathode 55 only after sufficient uranium has been collected at the solid cathode 45 to establish the preferred weight ratio of plutonium to uranium greater than 2:1. By using a reciprocating pounder liquid type cathode 55, as disclosed in application Ser. No. 08/272,376, now U.S. Pat. No. 5,443,705 filed simultaneous herewith, a high collection efficiency of greater than 95% may be obtained at the liquid metal cathode 55.

The numbers and dimensions shown in FIGS. 2A, 2B, 4 and 5 relate to a particular design process for 200 metric tons of heavy metal per year. The estimated current for the anode/solid cathode pair is 450 amps which compares to 200 amps obtainable in the present electrorefiner design at Argonne National Laboratory. In addition, the transport time using the subject invention is reduced by the elimination of inefficiencies as previously discussed and the present invention should improve the net transport rate by a factor of about 4.5 times. Moreover, with the present design, the liquid metal or cadmium cathode may have a larger diameter than previously available. It should be understood that the use of two solid cathodes 45 and one liquid cathode 55 per cell 10 is specific for a given feed requirement, but various other configurations may be used where necessary as is well understood by those skilled in the art. Various sizes of anode and cathode pairs can be designed to meet production rate requirements.

While there has been disclosed what is considered to be the preferred embodiment of the present invention, it is understood that various changes in the details may be made without departing from the spirit, or sacrificing any of the advantages of the present invention.

The embodiments of the invention in which an exclusive property or privilege is claimed are defined as follows:

1. A combination anode and cathode for an electrorefiner, comprising a hollow cathode, a liquid metal cathode having an upper surface within said hollow cathode, a molten electrolyte containing mixed chloride salts in contact with said hollow cathode, an anode positioned inside said hollow cathode such that a portion of the anode is near the hollow cathode, a retaining member at the bottom of the hollow cathode, and mechanism for providing relative movement between the anode and the hollow cathode during deposition of metal on the inside surface of said cathode, wherein said hollow cathode has an aperture in the wall thereof positioned above the upper surface of said liquid metal cathode, to permit flow of the electrolyte therethrough from inside said hollow cathode, during operation of the electrorefiner to refine spent nuclear fuel.

2. The combination of claim 1, wherein said cathode is an elongated tube.

3. The combination of claim 2, wherein said retaining member is a metallic screen at the bottom of said cathode tube electrically insulated therefrom.

4. The combination of claim 1, wherein said anode is positioned so that a portion thereof is within about one quarter inch to about one inch of the adjacent cathode surface.

5. A combination anode and cathode for an electrorefiner, comprising a hollow cathode, wherein said hollow cathode is an elongated tube, an anode positioned inside said hollow cathode tube such that a portion of the anode is near the cathode, a metallic screen of zirconium or an alloy thereof, at the bottom of said cathode tube and electrically insulated from said cathode tube by ceramic, and mechanism for providing relative movement between the anode and the cathode during deposition of metal on the inside surface of such cathode during operation of the electrorefiner to refine spent nuclear fuel.

6. A combination anode and cathode for an electrorefiner, comprising a hollow cathode, wherein said hollow cathode is an elongated tube, a liquid cadmium cathode within said hollow cathode tube, a molten electrolyte containing mixed chloride salts in contact with said hollow cathode tube, an anode positioned inside said hollow cathode tube such that a portion of the anode is near the cathode tube, wherein said anode is a plurality of porous containers extending axially from said cathode tube for rotation with respect thereto, a retaining member at the bottom of said cathode tube, and mechanism for providing relative movement between the anode and the cathode during deposition of metal on the inside surface of such cathode tube during operation of the electrorefiner to refine spent nuclear fuel.

7. The combination of claim 6, wherein said anode is cruciform in transverse cross section.

8. The combination of claim 6, wherein said anode is positioned so that a portion thereof is within a few inches of the adjacent cathode surface.

9. A process for refining spent nuclear fuel containing uranium and plutonium, comprising the steps of: providing an electrolytic cell having a molten electrolyte pool containing mixed metal chloride salts, a hollow cathode in contact with the electrolyte pool, an anode containing spent nuclear fuel positioned inside the hollow cathode such that a portion of the anode is near the cathode, a porous retaining member connected to the bottom of the cathode electrically insulated therefrom, mechanism providing relative movement between the anode and the cathode during deposition of uranium metal on the inside surface of said cathode during operation of the electrorefiner to refine spent nuclear fuel, electrical power means selectively connectable to the anode and the hollow cathode for providing electrical power to the cell components, electrically transferring uranium values and plutonium values from the anode to the electrolyte, and electrolytically depositing substantially pure uranium on the hollow cathode.

10. The process of claim 9, and further comprising a liquid metal cathode selectively connectable to the electrical power means for electrolytically depositing a mixture of uranium and plutonium on the molten cadmium cathode after substantially pure uranium has been deposited on the hollow cathode.

11. The process of claim 10, wherein the liquid metal cathode is electrically connected to the electrical power supply after the $PuCl_3$ to $UCl_3$ weight ratio is greater than 2:1.

12. The process of claim 10, wherein each anode is a plurality of porous containers generally rectangular in elevation defining a cavity for housing spent nuclear fuel, the relative movement between the anode and cathode causing an axially extending surface of the anode to move adjacent the associated cathode wall to scrape built up nuclear material therefrom.

13. The process of claim 12, wherein the liquid metal cathode is cadmium and further comprising a molten cadmium pool below the molten electrolyte.

14. The process of claim 12, wherein each anode container is generally rectangular in elevation mounted on an axially extending shaft for rotation with respect to the associated cathode, the cathode being tubular and the anode surface closest to the cathode wall being not more than one inch therefrom before nuclear material is deposited on the cathode during operation of the cell.

15. The process of claim 14, wherein the liquid metal cathode is submerged in the electrolyte with the liquid metal surface at a predetermined vertical position with respect to the hollow cathode, an opening in the hollow cathode wall above the liquid metal surface facilitating circulation of electrolyte from around the anode to the liquid metal cathode.

16. The process of claim 15, wherein there are two hollow tubular cathodes each having an anode positioned inside extending axially thereof.

17. An electrolytic cell for refining a spent nuclear fuel, comprising a molten salt electrolyte surrounding electrode means including at least one anode of spent nuclear fuel and at least one cathode surrounding said anode and adjacent thereto, means providing relative movement between the anode and the cathode, electrical power means selectively connected to the anode, and cathode for providing electrical power to the cell, and porous means at the bottom of said cathode for retaining metal which falls from the cathode during cell operation during which solid metal deposits on the inner surface of the hollow cathode.

18. The electrolytic cell of claim 17, wherein the molten salt is an alkali metal chloride having uranium and plutonium values and there are multiple anodes and cathodes with at least one of said cathodes being a hollow tube having an anode positioned therewithin extends axially thereof and having a surface which is within a few inches of said cathode.

19. The electrolytic cell of claim 18, wherein the relative movement is rotation of said anode positioned within said tubular cathode such that said anode scrapes uranium deposited on said cathode wall during operation of said cell and wherein at least one of the cathodes is a liquid Cd cathode positioned within said electrolyte and selectively connectable to said power means, the liquid Cd cathode surface positioned below a slot in the hollow tubular cathode which facilitates flow of electrolyte from near the anode material inside the tubular cathode to the liquid Cd cathode.

* * * * *